US009028589B2

(12) United States Patent
Laitinen et al.

(10) Patent No.: US 9,028,589 B2
(45) Date of Patent: May 12, 2015

(54) METHOD AND DEVICE FOR GAS CLEANING

(76) Inventors: Ari Laitinen, Tampere (FI); Kauko Janka, Tampere (FI); Jorma Keskinen, Tampere (FI)

( * ) Notice: Subject to any disclaimer, the term of this patent is extended or adjusted under 35 U.S.C. 154(b) by 468 days.

(21) Appl. No.: 13/498,188

(22) PCT Filed: Oct. 1, 2010

(86) PCT No.: PCT/FI2010/050763

§ 371 (c)(1),
(2), (4) Date: Mar. 26, 2012

(87) PCT Pub. No.: WO2011/039422

PCT Pub. Date: Apr. 7, 2011

(65) Prior Publication Data

US 2012/0180659 A1 Jul. 19, 2012

(30) Foreign Application Priority Data

Oct. 1, 2009 (FI) ..... 20096004 U

(51) Int. Cl.
*B03C 3/34* (2006.01)
*B03C 3/08* (2006.01)
(Continued)

(52) U.S. Cl.
CPC ... *B03C 3/08* (2013.01); *B03C 3/12* (2013.01); *B03C 3/14* (2013.01); *B03C 3/366* (2013.01); *B03C 3/47* (2013.01)

(58) Field of Classification Search
CPC ..... B03C 3/00; B03C 3/04; B03C 3/06; B03C 3/08; B03C 3/12; B03C 3/28; B03C 3/30; B03C 3/34; B03C 3/366; B03C 3/38; B03C 3/40; B03C 3/41; B03C 3/45; B03C 3/49; B03C 3/47; B03C 3/14; B03C 9/00; B03C 11/00; B03C 2201/20; B03C 3/017; B05B 1/00; B05B 1/005; B05B 1/02; B05B 5/025; B05B 5/0255; B05B 5/03; B05B 5/032; F01N 3/01; H05H 1/34; H05H 2245/12; H05H 2245/121; H05H 2245/1215
USPC ..... 95/15, 27, 57, 58, 60, 62, 73, 79, 95, 95/98; 96/60
See application file for complete search history.

(56) References Cited

U.S. PATENT DOCUMENTS 4,093,430 A * 6/1978 Schwab et al. ..... 96/27
4,110,086 A * 8/1978 Schwab et al. ..... 95/75
(Continued)

FOREIGN PATENT DOCUMENTS

CN 101089373 A 12/2007
EP 1867380 A1 12/2007
(Continued)

OTHER PUBLICATIONS

Chinese Patent Office—First Office Action—Mar. 28, 2014 (With Translation) (Issued in Chinese Application No. 201080043971.4).
(Continued)

*Primary Examiner* — Duane Smith
*Assistant Examiner* — Sonji Turner
(74) *Attorney, Agent, or Firm* — Venable LLP; Eric J. Franklin

(57) ABSTRACT

A method for separating particles from particle-laden gas. Charged particles are formed by charging particles of a particle-laden gas. A gas jet is provided by guiding the particle-laden gas by a flow guide. Particles from the gas jet are collected to a collecting electrode by an electric field. An effective collecting area of the collecting electrode is positioned such that gas velocity gradient at each point of the effective collecting area is smaller than 10% of the maximum gas velocity in the gas jet divided by the height dimension of the jet.

21 Claims, 11 Drawing Sheets

(51) Int. Cl.

| | |
|---|---|
| ***B03C 3/12*** | (2006.01) |
| ***B03C 3/14*** | (2006.01) |
| ***B03C 3/36*** | (2006.01) |
| ***B03C 3/47*** | (2006.01) |

(56) References Cited

U.S. PATENT DOCUMENTS

| | | | | |
|---|---|---|---|---|
| 5,961,693 | A * | 10/1999 | Altman et al. | 95/78 |
| 6,096,118 | A * | 8/2000 | Altman et al. | 96/50 |
| 6,436,170 | B1 * | 8/2002 | McDermott et al. | 95/58 |
| 6,824,587 | B2 * | 11/2004 | Mohamed | 95/7 |
| 6,899,748 | B2 * | 5/2005 | Mohamed | 96/3 |
| 7,267,708 | B2 * | 9/2007 | Chabek et al. | 95/64 |
| 2004/0216607 | A1 | 11/2004 | Mohamed | |

FOREIGN PATENT DOCUMENTS

| | | | |
|---|---|---|---|
| JP | 57122952 | A | 7/1982 |
| JP | 10043631 | A | 2/1998 |
| JP | 2008183540 | A | 8/2008 |
| WO | WO-2004/094065 | A1 | 11/2004 |

OTHER PUBLICATIONS

PCT/ISA/210—International Search Report—Feb. 4, 2011.
Finnish Office Action—May 24, 2010.

* cited by examiner

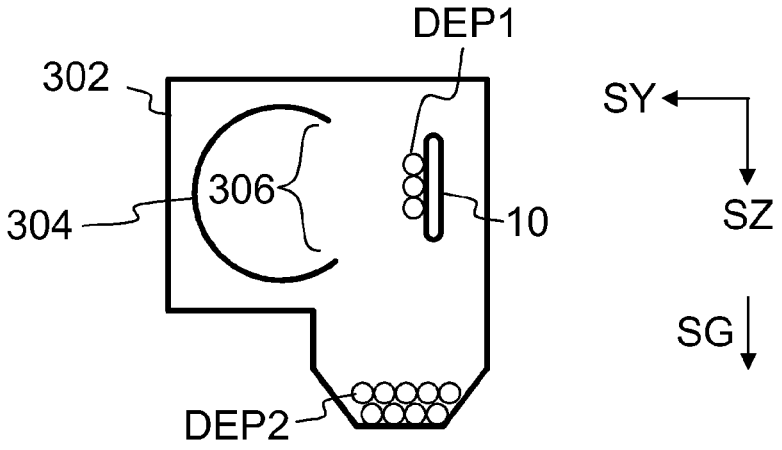
Fig 7
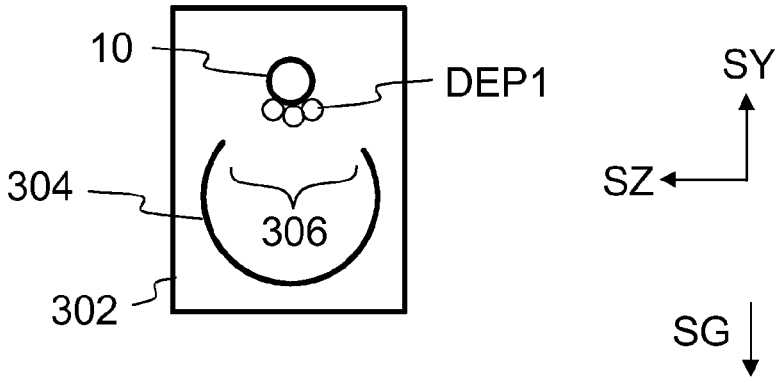
Fig 8 COMPARATIVE EXAMPLE

METHOD AND DEVICE FOR GAS CLEANING

CROSS-REFERENCE TO RELATED APPLICATIONS

This application claims priority to Finnish patent application 20096004 filed 1 Oct. 2009 and is the national phase under 35 U.S.C. §371 of PCT/FI2010/050763 filed 1 Oct. 2010.

FIELD OF THE INVENTION

The invention relates to separating particles from a gas.

BACKGROUND

Aerosol particles may be formed in combustion processes, e.g. when combusting wood, wood pellets, peat, or municipal waste. Aerosol particles may also be formed in industrial processes such as hot galvanization, welding, or glass smelting. Said aerosol particles are often harmful to the environment or health. In particular, so called nanoparticles may cause health problems when inhaled, because they may penetrate into human lungs. Toxic heavy metals vaporized in industrial processes may also be condensed and enriched in nanoparticles. The term nanoparticle refers herein to particle diameters smaller than or equal to 500 nm.

It is known that aerosol particles may be separated from flue gases by using filtration, or by using electrostatic precipitators. Electrostatic precipitators are typically characterized by a low pressure drop and the ability to handle high particle concentrations.

In conventional electrostatic precipitators, particles are typically charged by means of a corona discharge, and the charged particles are displaced to collection plates by means of an electric field. Typically, charging and electrical displacement are arranged to take place in the same volume. In conventional electrostatic precipitators, the aim is to use a high electric field together with a low charge density, because a strong electric field combined with a high charge density would increase energy consumption. Efficient charging of particles in the 1-100 μm regime requires a strong electric field. Conventional electrostatic precipitators are typically optimized for separating particles whose diameters are in the range of 1 to 100 μm.

On the other hand, efficient charging of nanoparticles requires a high charge density in the particle-laden gas. Thus, conventional electrostatic precipitators are typically not very effective and/or economical when the task is to separate nanoparticles.

A problem with Prior Art solutions for cleaning collection plates of an electrostatic precipitator is that particles loosened during the cleaning process may be captured back to the gas stream. This may be avoided if the gas flow is shut off during the cleaning process. However, this may make the gas cleaning system more complex.

Particles may be charged by a corona discharge such that charging takes place separately from the electrical displacement. However, in that case particles may be deposited on all surfaces in the vicinity of the corona electrode, and this can make cleaning of an electrostatic precipitator more difficult.

SUMMARY

An object of the invention is to provide a device for gas cleaning. An object of the invention is also to provide a method for gas cleaning.

According to a first aspect of the invention, there is provided a gas cleaning device (500) comprising:

- a charging unit (150) arranged to form charged particles (P1) by charging particles (P0) of a particle-laden gas (FG),
- a flow guiding structure (30) arranged to provide a gas jet (JET1) by guiding said particle-laden gas (FG), and
- a collecting electrode (10) having an effective collecting area (EFFZ) arranged to collect particles (P1) from said gas jet (JET1) by an electric field (E1), wherein said effective collecting area (EFFZ) is positioned such that gas velocity gradient ($\Delta v/\Delta y$) at each point of said effective collecting area (EFFZ) is smaller than or equal to 10% of the maximum gas velocity ($V_{MAX}$) of said gas jet (JET1) divided by the height dimension (d1') of said jet, said height dimension (d1') being determined at the location of said flow guiding structure (30).

According to a second aspect of the invention, there is provided a method for separating particles (P0,P1) from particle-laden gas (FG), said method comprising:

- forming charged particles (P1) by charging particles (P0) of a particle-laden gas (FG),
- providing a gas jet (JET1) by guiding said particle-laden gas (FG) by a flow guiding structure (30), and
- collecting particles (P1) from said gas jet (JET1) to an effective collecting area (EFFZ) of a collecting electrode (10) by an electric field (E1), wherein said effective collecting area (EFFZ) is positioned such that gas velocity gradient ($\Delta v/\Delta y$) at each point of said effective collecting area (EFFZ) is smaller than or equal to 10% of the maximum gas velocity ($V_{MAX}$) in said gas jet (JET1) divided by the height dimension (d1') of said jet, said height dimension (d1') being determined at the location of said flow guiding structure (30).

According to the invention, particles are first charged, and the charged particles are subsequently separated from a gas flow to a collecting electrode such that the effective collecting area of the electrode is substantially separate from the gas flow. Thus, particles can be removed from the electrode during a clearing procedure of the electrode such that they are not captured back to the gas flow. Consequently, high collection efficiency for nanoparticles may be attained.

In an embodiment, particle-free ionized gas is generated by an ion source, and the particles are charged by mixing the ionized gas with particle-laden gas in a mixing region. Consequently, the ion source is not contaminated, and there is no need to clean it. Thanks to mixing ionized gas with particle-laden gas, the residence time may be long, and the efficiency of charging the nanoparticles may be increased.

When charging of the particles and collecting of the particles are performed separately, this may provide considerable freedom to select operating parameters of the gas cleaning device. For example, a high electric field may be used for displacing charged particles from the gas flow, without excessively increasing electric power consumption of the gas cleaning device. (When the same electric field is used for charging and collecting, a higher electric field may lead to an increased corona current, and subsequently also to excessively high power consumption).

The temperature and gas composition inside the ion source may substantially deviate from the temperature and gas composition of the particle laden (flue) gas. This may allow optimization e.g. in terms of lifetimes of electrodes, materials or electrodes, and/or power consumption.

Because charging of the particles and collecting of the particles are performed separately, the mixing region does not need to comprise electrode pairs which would deflect the ions away from the mixing region. Consequently, the surfaces in the mixing region may remain substantially clean. Thus, the gas cleaning device may be substantially maintenance-free. In fact, the collecting electrode may be the only component which is expected to require regular maintenance.

Furthermore, the ions may have an extended lifetime in the mixing region, because the electric field in the mixing region is very small. Therefore, it is easier to implement a high charge density than in a conventional electrostatic precipitator. Thus, the gas cleaning device may be operated effectively with low power consumption.

Because charging of the particles and collecting of the particles are performed separately, particles deposited on the collecting electrode do not disturb the operation of the ion source.

Because charging of the particles and collecting of the particles are performed separately, an electric current density on surface of the collecting electrode may be low. Consequently, electrically insulating particles deposited on the collecting electrode do not significantly reduce the strength of the particle-deflecting electric field.

Because charging of the particles and collecting of the particles are performed separately, the spatial distribution of a particle-deflecting electric field can be selected so that charged particles impinge substantially only on the collecting electrode. This reduces the need to clean other surfaces inside the gas cleaning device, i.e. surfaces which are not on the collecting electrode.

The embodiments of the invention and their benefits will become more apparent to a person skilled in the art through the description and examples given herein below, and also through the appended claims.

BRIEF DESCRIPTION OF THE DRAWINGS

In the following examples, the embodiments of the invention will be described in more detail with reference to the appended drawings in which FIG. 7 shows positioning a collecting electrode to the side of a gas flow duct, FIG. 8 shows a collecting electrode positioned above the gas flow duct.

DETAILED DESCRIPTION

Figure 1A:
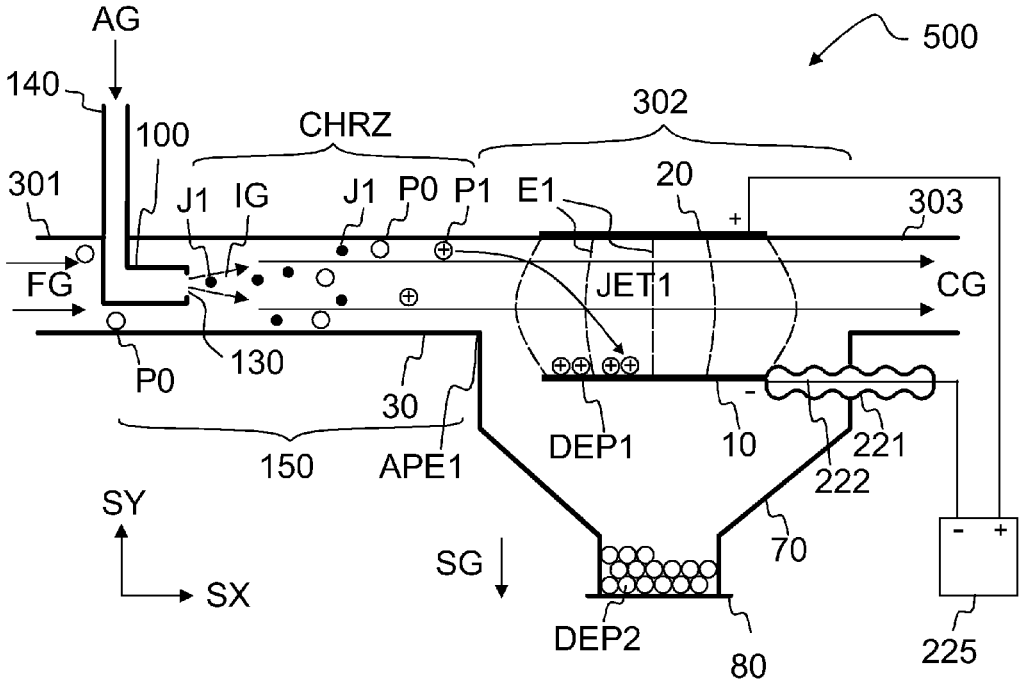
FIG. 1*a* shows a gas cleaning device comprising an ion supply, a particle charging zone, a flow guiding structure, and a particle collecting electrode.

Referring to FIG. 1, a gas cleaning device 500 may comprise a particle charging unit 150, a flow guiding structure 30, and a particle collecting electrode 10.

Particle laden gas FG may be introduced to the gas cleaning device 500 via an inlet duct 301.

The charging unit 150 is arranged to form charged particles P1 by charging neutral particles P0 of a particle-laden gas stream FG. The particle laden gas FG may be e.g. flue gas from a combustion process.

The particles P0 may be e.g. solid or liquid particles. The diameter of the particles P0 may be e.g. in the range of 5 nm to 500 nm.

The charging unit 150 may comprise an ion source 100 and the inlet duct 301. The ion source 100 is arranged to provide a flow of ionized gas IG. The ionized gas IG comprises ions J1, which are shown as black dots in FIG. 1*a*.

The ionized gas IG may be introduced to the inlet duct 301 via a nozzle 130. Substantially particle-free gas AG may be guided to the ion supply 100 via a tube 140.

The ionized gas may be mixed with the particle-laden gas FG so as to provide a mixture of the ions J1 and particle-laden gas FG.

As the unipolar ions J1 of the ionized gas IG repel each other, the ions J1 may be mixed with the particle laden gas FG by electrostatic forces.

The particle-laden FG gas and the ionized gas IG may also be mixed e.g. by turbulence caused by a stream of ionized gas IG flowing through the nozzle 130. In other words, the nozzle 130 may be arranged to enhance mixing by turbulence.

Charge may be transferred from the ions J1 to neutral particle P0 of the particle-laden gas FG in a particle charging zone CHRZ. A portion of the inner volume of the inlet duct 301 may be used as a charging region CHRZ.

A significant fraction of neutral particles P0 may be converted into charged particles P1 in the charging zone CHRZ. Gas carrying the charged particles P1 may be ejected as a gas jet JET1 into a space between a particle collecting electrode 10 and a counter-electrode 20.

A voltage applied between a particle collecting electrode 10 and a counter-electrode 20 may create an electric field E1, which deflects the charged particles P1 to the collecting electrode 10. The polarity of the collecting electrode 10 is selected such that it attracts the charged particles P1. In other words, the electric field E1 deflects charged particles P1 away from the gas jet JET1 and moves the deflected charged particles P1 to the surface of the collecting electrode 10.

The ion source 100 may be arranged to operate such that the generated ions J1 are unipolar. For example, the ion source 100 may be arranged to operate such that more than 90% of the generated ions are positive and less than 10% of the generated ions are negative. Alternatively, the ion source 100 may be arranged to operate such that more than 90% of the generated ions are negative and less than 10% of the generated ions are positive. Consequently, the majority of particles P1 charged in the charging zone CHRZ are either positive or negative.

The voltage may be generated by a high voltage source 225. The voltage may be coupled to the collecting electrode 10 via a conductor 222 passing through an insulator 221. The collecting electrode 10 may also be mechanically supported by the conductor 222 and/or by insulator 221.

In order to maximize collection efficiency, the voltage source 225 may be arranged to operate such that the voltage coupled between the electrodes 10, 20 is slightly lower than electrical breakdown limit. The electric field E1 created by the collecting electrode E1 may be (e.g. 5%-30%) smaller than the smallest electric field, which causes electric breakdown in the surrounding gas. The electrical breakdown limit may be e.g. 7 kV/cm.

The flow guiding structure 30 may be arranged to direct the gas jet JET1 such that said gas jet JET1 does not blow away particles DEP1 deposited on the collecting electrode 10.

The flow guiding structure 30 may be arranged to direct the gas jet JET1 such that said gas jet JET1 does significantly capture deposited particles DEP1, which are subsequently released from collecting electrode 10 as agglomerates.

The collecting electrode 10 may be located in an electrode chamber 302. Cleaned gas CG may be guided away via an outlet duct 303. The electrode chamber 302 is preferably gas-tight, and it is in fluid connection with the inlet duct 301 and the outlet duct 303.

Particles DEP1 deposited on the electrode 10 may occasionally fall from the electrode 10 to the bottom of the electrode chamber 302 due to gravity. The particle deposit DEP2 on the bottom may be manually or automatically removed from the chamber 302 e.g. via a lid 80. The chamber 302 may further comprise a funnel 70 for collecting the deposit DEP2 into a smaller bottom area.

Figure 2:
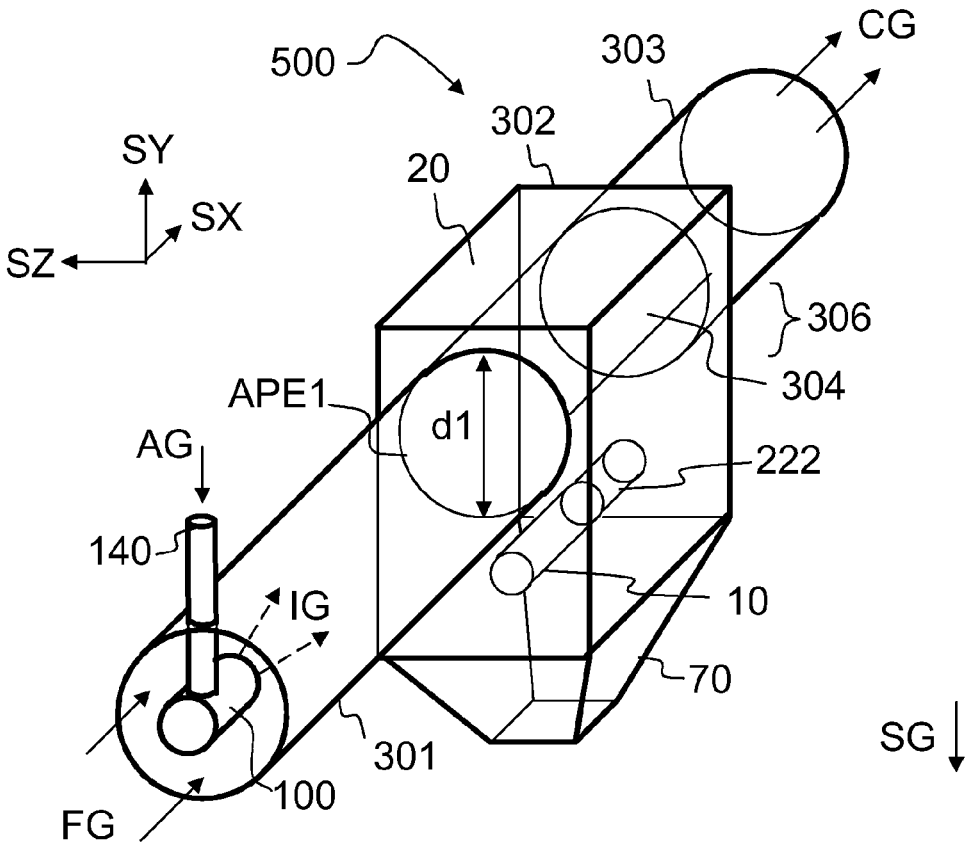
FIG. 2 shows, in a three dimensional view, a gas cleaning device.
Figure 12A:
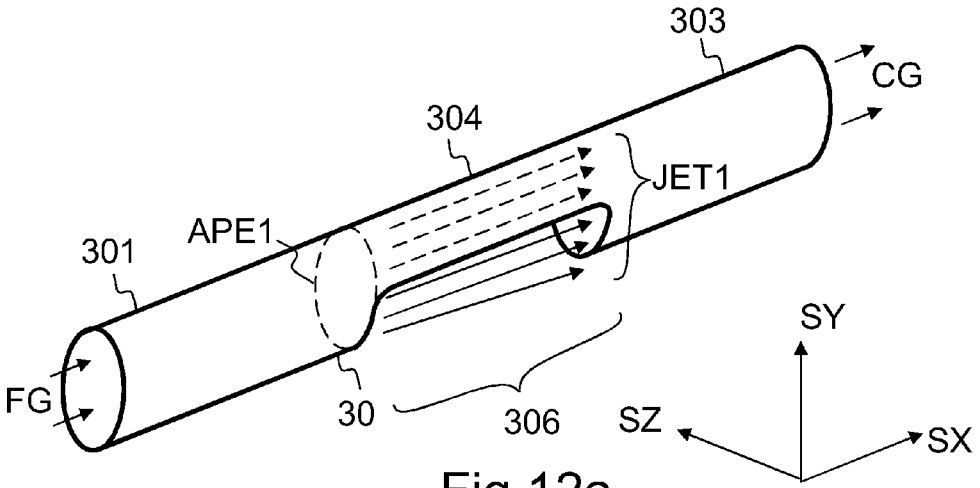
FIG. 12*a* shows, in a three dimensional view, a gas jet formed by a duct, which has an opening on the side.
Figure 12B:
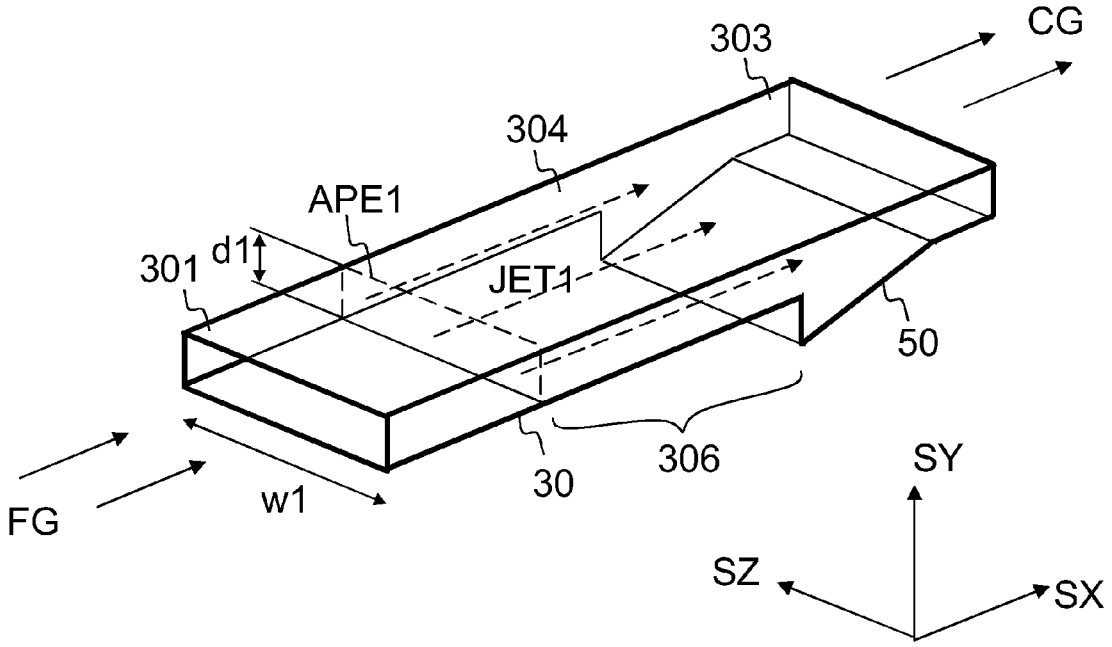
FIG. 12*b* shows, in a three dimensional view, a duct, which has a substantially rectangular cross section.

SX, SY, and SZ denote orthogonal directions (see also FIGS. 2, 12*a*, and 12*b*). The direction of gas flow in the vicinity of the glow guiding structure 30 may be substantially parallel to the direction SX. SG denotes the direction of gravity.

Figure 1B:
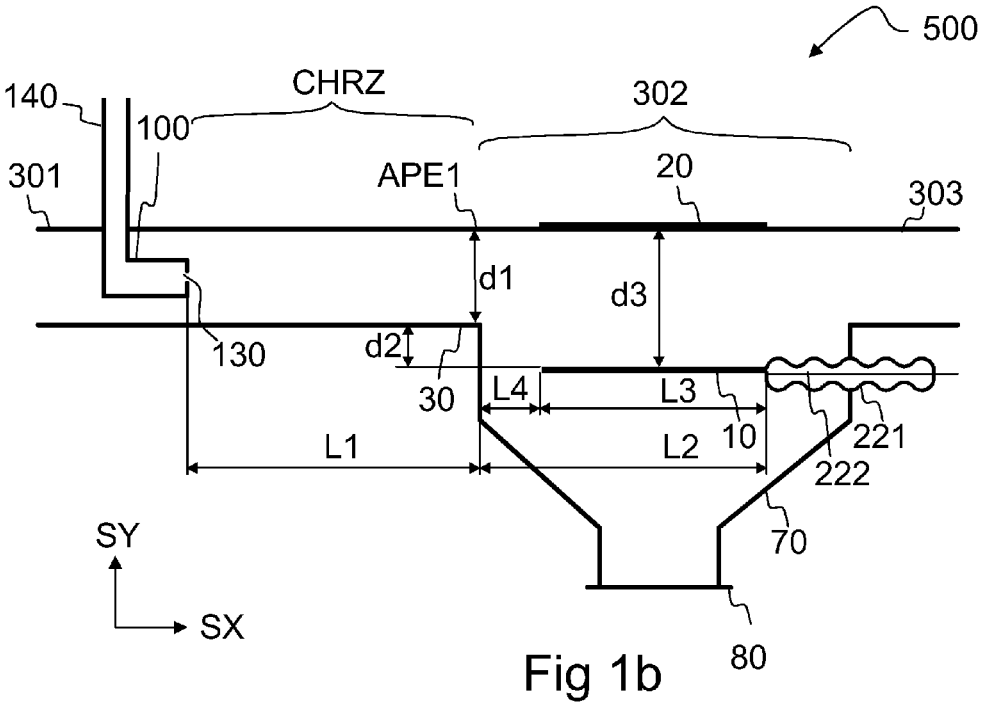
FIG. 1*b* shows dimensions of the gas cleaning device of FIG. 1*a*.

FIG. 1*b* shows dimensions of the gas cleaning device 500 according to FIG. 1*a*.

The flow guiding feature 30 may be e.g. a portion of the gas inlet duct 301.

L1 denotes the length of the charging zone CHRZ, i.e. the distance between the ion injection nozzle 130 and the end of the gas guiding feature 30.

The length L1 of the charging zone CHRZ may be e.g. greater than or equal to 50 cm. The length L4 may be the distance between the collecting electrode 10 and the gas guiding feature 30. The (longitudinal) distance L1+L4 between the nozzle 130 and the collecting electrode 10 may be e.g. greater than or equal to 50 cm. The (longitudinal) distance L1+L4 between the nozzle 130 and the effective particle-collecting area EFFZ of the electrode 10 may be greater than or equal to 50 cm.

Particles smaller than 1.0 μm are charged primarily by a process known as diffusion charging. Charging efficiency depends in that case on the concentration of ions J1, on the residence time in the charging zone CHRZ, and on the temperature of the gas.

The residence time in the charging zone CHRZ may be increased by increasing the length L1. The increased residence time increases the probability for charge transfer from an ion J1 to a neutral particle P0. However, the length L1 should not be too long, because in that case the charged particles P1 may be neutralized on the walls of the inlet duct 301 to a significant degree. The residence time in the charging zone CHRZ may be e.g. in the range of 0.05 s to 1 s, and preferably in the range of 0.1 to 0.2 s. If the residence time is too short, charge is not transferred effectively from the ions J1 to the particles P0. If the residence time is too long, a signification fraction of the charged particles P1 may impinge on the walls of the duct 301, thereby being neutralized.

The initial cross section of the gas jet JET1 is defined by a flow aperture APE1, which is located at the end of the gas guiding feature 30. Thus, the gas guiding feature 30 at least partially defines the flow aperture APE1.

The dimension d1 denotes the inner height dimension of the flow defining aperture APE1. The dimension d1 is determined in a direction, which is parallel to the average direction (i.e. main direction) of the electric field E1 prevailing in the gas jet JET1. In FIGS. 1*a* and 1*b*, the main direction of the electric field E1 is parallel to the direction SY.

The dimension d1 may be equal to the inner dimension of the gas duct 301 at the location of the end of the gas guiding feature 30. In case of a substantially circular duct, the dimension d1 may be equal to the diameter of the inlet duct 301.

Figure 4A:
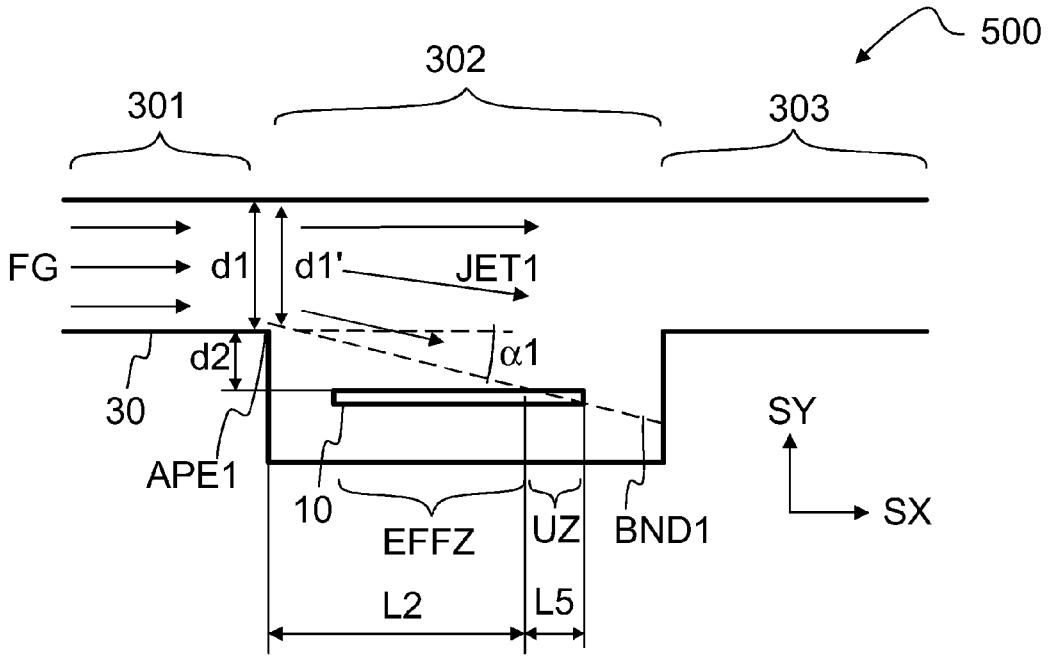
FIG. 4*a* shows guiding a gas flow such that it does not impinge on the effective particle-collecting area of the collecting electrode.

To the first approximation, the height dimension d1' of the gas jet JET1 may be considered to be substantially equal to the dimension d1 of the aperture APE1 (See FIG. 4*a*). The height dimension d1' of the gas jet JET1 is determined at the location of the flow guiding structure 30, i.e. at the location of the aperture APE1. The height dimension d1' of the gas jet JET1 may be determined at the location where the flow guiding structure 30 has a minimum height.

The distance d2 denotes the vertical distance between the collecting surface of the electrode 10 and the end of the gas guiding feature 30. The length L2 denotes the maximum distance between the gas guiding feature 30 and the effective collecting area of the electrode 10. The length L3 denotes the length of the effective collecting area of the electrode 10.

d3 denotes a distance between the collecting electrode 10 and the counter-electrode 20. To the first approximation, the electric field E1 between the electrodes 10, 20 is inversely proportional the distance d3. L4 denotes the minimum distance between the collecting electrode 10 and surrounding conductive structures. Typically, L4 sets the limit to the maximum electric field E1, which can be applied between the electrodes 10, 20.

FIG. 2 shows a three-dimensional view of a gas cleaning device 500. The cross-section of the collecting electrode 10 may be e.g. circular so as to facilitate falling of the deposits DEP1 away from the electrode 10.

The electrode 10 may also be e.g. a substantially planar plate (See FIG. 7).

In order to avoid corona discharges in the electrode chamber 302, the electrode 10 may be constructed such that it does not have sharp edges.

The gas cleaning device 500 may comprise one or more adjacent collecting electrodes 10.

A portion of a gas flow duct 304 positioned in the electrode chamber 302 may have a cut-out (opening) 306 so as to allow transverse drifting of charged particles out of the gas flow duct 304. The gas flow duct 304 may form a substantially continuous tube together with the inlet duct 301 and the outlet duct 303 (See also FIG. 12*a* and FIG. 12*b*).

If the gas flow duct 304 or the top of the electrode chamber 302 is electrically conductive, it may be used as the counter-electrode 20. In particular, the gas flow duct 304 and/or the top of the electrode chamber 302 may be made of metal.

The counter-electrode 20 may also be electrically insulated from the electrode chamber 302, in order to increase the strength of the electric field E1 (this embodiment is not shown). However, in that case a further electric field is created between the other conductive parts of the electrode chamber 302 and the counter electrode 20. The counter-electrode 20 should be dimensioned such that the further electric field does not inadvertently deflect charged particles P1 to those conductive surfaces within the electrode chamber 302, which are exposed to high gas velocities.

In principle, also the ground (i.e. earth or water pipeline system of a house) may be used as the counter-electrode 20, if the electrode chamber 302 is made of electrically insulating material. However, in that case the electric field E1 may be rather weak.

Figure 3:
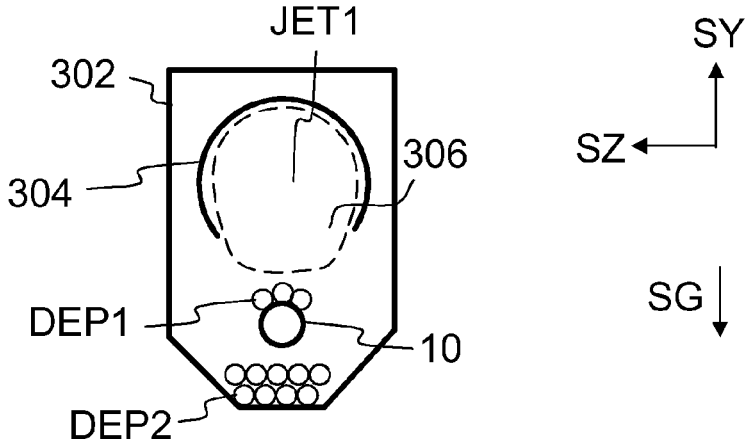
FIG. 3 shows the position of a collecting electrode with respect to a gas jet.

Referring to FIG. 3, the opening 306 of the gas flow duct 304 may be positioned above the collecting electrode 10. Thus, particles DEP1 deposited on the collection electrode 10 cannot fall back to the gas flow duct 304 due to gravity. Instead, the particles DEP1 deposited on the collection electrode 10 may fall to the bottom of the electrode chamber 302, forming another deposit DEP2.

Collected particles DEP1 may be removed from the collecting electrode by mechanical vibration, e.g. by rapping or hammering. Thanks to the invention, only a minimum amount of particles are released back to the gas jet JET1.

The particles may also be removed e.g. by washing with a liquid, in particular with water.

Referring to FIG. 4*a*, particle-laden gas flow FG is guided to the electrode chamber 302 by a flow guiding structure 30, thereby forming a gas jet JET1. The flow guiding structure 30 may be a portion of the inlet duct 301.

The gas jet JET1 may diverge in the electrode chamber 302. The gas jet JET1 has a boundary BND1. The boundary BND1 refers to a limit where the gas velocity has decreased to a value, which is 10% of the maximum gas velocity at the center of jet JET1.

Charged particles P1 may be deflected away from the gas jet JET1 to the collecting electrode 10 by the electric field E1 (FIG. 1). Particles collected on the electrode 10 are typically neutralized, which means that they are no more adhered to the electrode 10 by the electric field E1.

This, in turn means that the deposited particles may be rather easily blown away from the electrode 10 by a high velocity gas. Entrainment of neutralized particles back into the gas jet JET1 may drastically reduce the collection efficiency.

The effective particle-collecting area EFFZ of the electrode 10 is preferably positioned outside the gas jet JET1.

In particular, the device 500 for separating particles P0 from the gas FG may comprise:

a means (30) for forming a gas jet JET1.

a means for charging said particles (P0), and at least one collecting electrode (10) arranged to collect said particles (P0, P1) by using an electric field (E1), wherein said collecting electrode (10) is substantially separate from said gas jet JET1.

The effective particle-collecting area EFFZ of the electrode 10 is preferably positioned outside the boundary BND1 of the gas jet JET1, wherein the position of said boundary BND1 is determined without the presence of the electrode 10. In particular, the effective particle-collecting area EFFZ of the electrode 10 may be positioned below the boundary BND1 of the gas jet JET1, wherein the position of said boundary BND1 is determined without the presence of the electrode 10. The position of the boundary BND1 is determined without the presence of the electrode 10, because according to fluid dynamics, gas velocity is equal to zero at the surface of a solid object.

$\alpha$1 denotes an angle between the boundary BND1 of the gas jet JET1 and the main direction of the gas flow immediately before the location of the aperture APE1. In case of a large electrode chamber 302, the angle $\alpha$1 may be e.g. in the range of 10° to 15°.

Thus, the maximum distance L2 between the flow guiding structure 30 and the boundary of the effective collecting area EFFZ may be estimated by the equation:

$$L2 = \frac{d2}{\tan(\alpha 1)}, \tag{1}$$

wherein $\alpha$1 is equal to e.g. 15 degrees.

The flow-defining aperture APE1 may be defined e.g. by an end of the inlet duct 301. If the electrode chamber 302 has a gas flow duct 304 with an opening 306 (See FIGS. 2, 3, 12*a*, and 12*b*), then the bottom side of the aperture APE1 may be defined by the first edge of the cut-out 306.

According to fluid dynamics, the gas velocity on the inner surface of the inlet duct 301 is equal to zero. Thus, in theory, the height dimension d1' of the gas jet JET1 at the location of the flow-defining aperture APE1 may be slightly smaller than the height dimension d1 of the aperture APE1. However, to the first approximation, the height dimension d1' of the gas jet JET1 may be considered to be substantially equal to the dimension d1 of the aperture APE1.

The aperture APE1 may also be defined by an array of adjacent nozzles arranged to stabilize gas flow (not shown). In that case the dimension d1 refers to the combined height dimension of the nozzles, and the dimension d1' refers to the combined height dimension of the resulting gas jet JET1. In particular, the nozzles may be honeycomb nozzles.

Figure 4B:
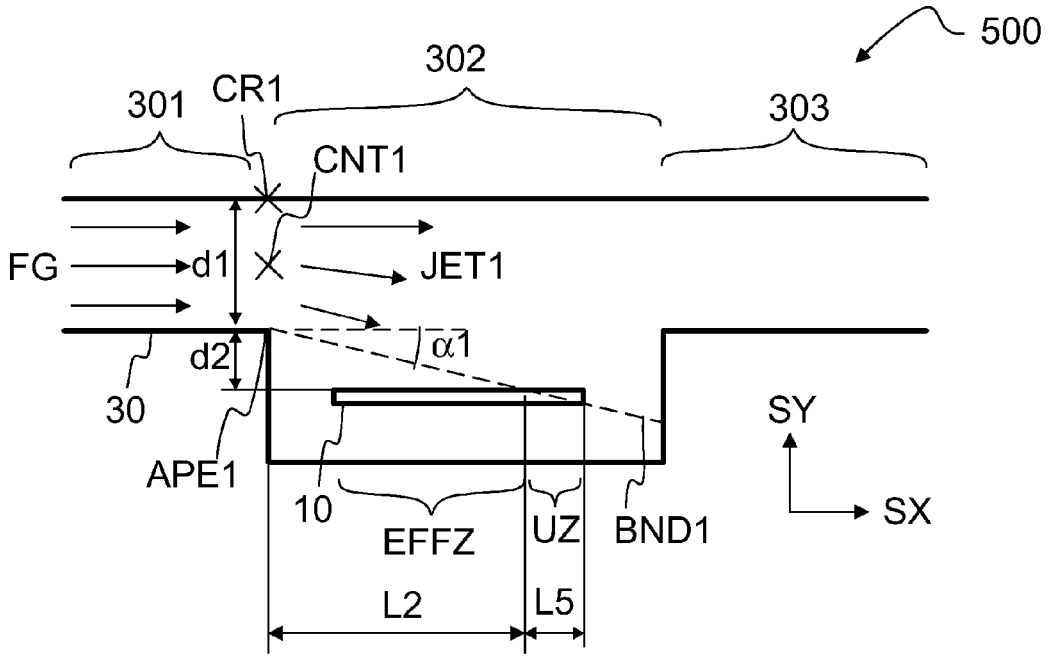
FIG. 4*b* shows a first point in the center of the gas flow and a second point at the top of a flow-defining aperture.

Referring to FIG. 4*b*, CR1 denotes the uppermost point of the aperture APE1. The operating parameters of the gas cleaning device 500 may be selected such that charged particles P1 traveling in the vicinity of the position CR1 can be deflected such that they impinge on the effective collecting area EFFZ. Said operating parameters include:

the length L3 of the effective collecting area EFFZ (see FIG. 1*b*), the distance L2 between the aperture APE1 and the boundary of the effective collecting area EFFZ, the sum of the dimensions d1 and d2, the voltage applied between the collecting electrodes 10 and the counter-electrode 20, and gas velocity in the inlet duct 301.

The traveling time $\tau_{DRIFT}$ of a charged particle P1 from the point CR1 to the collecting electrode 10 can be estimated by the equation:

$$\tau_{DRIFT} = \frac{d1 + d2}{v_{DRIFT}}, \tag{2}$$

where $v_{DRIFT}$ denotes the transverse (i.e. vertical) drifting velocity of a particle P1 caused by the electric field E1. The traveling time $\tau_{DRIFT}$ may also be called as a residence time.

The horizontal distance $L_H$ traveled by the particle P1 during the time $\tau_{DRIFT}$ can be estimated by the equation:

$$L_H = v_G \tau_{DRIFT} \tag{3a}$$

where $v_G$ denotes average (horizontal) gas velocity in the electrode chamber 302 between the electrodes 10, 20.

The average (horizontal) gas velocity in the electrode chamber may be e.g. in the range of 0.2 to 20 m/s, and preferably e.g. in the range of 0.5 m/s to 2 m/s.

The height dimension d1' of the jet JET1 may be e.g. in the range of 1 to 60 cm, and preferably in the range of 5 cm to 30 cm. The dimension d2 may be e.g. in the range of 30 to 70% of the dimension d1'.

The height dimension d1 of the aperture APE1 may be e.g. in the range of 1 to 60 cm, and preferably in the range of 5 cm to 30 cm. The dimension d2 may be e.g. in the range of 30 to 70% of the dimension d1.

The drifting velocity $v_{DRIFT}$ of 100 nm particle may be e.g. in the range of 5 cm/s to 100 cm/s. The drifting velocity $v_{DRIFT}$ depends on the electric field E1. The drifting velocity $v_{DRIFT}$ is typically in the range of 10 cm/s–30 cm/s.

The electric field E1, and the gas velocity $v_G$ may be selected such that the drifting velocity $v_{DRIFT}$ is greater than or equal to e.g. 10% of the gas velocity $v_G$. In particular, the drifting velocity $v_{DRIFT}$ may be greater than or equal to 30% of the gas velocity $v_G$.

Eq. (3a) can also be expressed in the following form by inserting $\tau_{DRIFT}$ obtained from the equation (2):

$$L_H = \frac{(d1 + d2)v_G}{v_{DRIFT}} \tag{3b}$$

The effective collecting area EFFZ should be long enough so as to ensure that charged particles P1 carried in the vicinity of the position CR1 have sufficient time to drift to the effective collecting area EFFZ. In order to collect substantially all charged particles, the effective collecting area EFFZ should be positioned such that:

$$L2 \geq L_H \tag{4a}$$

In other words, the position of the furthermost end of the effective collecting area EFFZ may be selected such that $$L2 \geq \frac{(d1 + d2)v_G}{v_{DRIFT}} \tag{4b}$$

Charged particles P1 carried at the center CNT1 of the jet JET1 may be collected if the position of the furthermost end of the effective collecting area EFFZ is selected according to the following equation $$L2 \geq \frac{\left(\frac{d1}{2} + d2\right)v_G}{v_{DRIFT}} \tag{4c}$$

The electric field E1, the gas velocity $v_G$, and the dimensions d1 and d2 may be selected such that the traveling time $\tau_{DRIFT}$ of a 100 nm particle is e.g. in the range of 0.05 s to 20 s. In particular, the electric field E1, the gas velocity $v_G$, and the dimensions d1 and d2 may be selected such that the traveling time $\tau_{DRIFT}$ of a 100 nm particle is preferably in the range of 0.5 s to 2 s. This is expected to provide an optimum mechanical size for the gas cleaning device 500.

The electric field E1, a gas velocity $v_G$, and a transverse distance 0.5·d1+d2 from the center CNT1 of the jet JET1 to the collecting electrode 10 may be selected such that a traveling time $\tau_{DRIFT}$ of a 100 nm particle from the center CNT1 of the gas jet JET1 to the collecting electrode 10 is in the range of 0.5 to 2 s.

The electric field E1, the gas velocity $v_G$, and the dimension d1' may be selected such that the traveling time $\tau_{DRIFT}$ of a 100 nm particle is preferably in the range of 0.5 s to 2 s.

The gas velocity $v_G$ may be e.g. approximately equal to three times the drifting velocity $v_{DRIFT}$, and the dimension d1 may be approximately equal to 50% of the dimension d1. With these typical parameters, equation (4c) defines that L2≥3·d1. In other words, the maximum distance L2 between the gas guiding feature 30 and the furthermost end of the effective collecting area (EFFZ) of the electrode 10 may be greater than or equal to three times the height dimension d1 of the aperture APE1.

The length L3 of the effective collecting area EFFZ may be e.g. approximately equal to the distance L2, and the height dimension d1' of the jet JET1 may be approximately equal to the height dimension d1 of the aperture APE1. Thus, by inserting typical operating parameters in the equation (4c), it may be derived that the length L3 of the effective collecting area EFFZ may be greater than or equal to three times the height dimension d1' of the jet JET1.

The collecting electrode 10 may comprise a residual area UZ, which is exposed to the gas jet JET1, i.e. particles on the residual area may be blown away rather easily by the gas jet JET1. In other words, the residual area UZ does not effectively remove particles from the gas jet JET1. L5 denotes the length of the residual area UZ.

Figure 5:
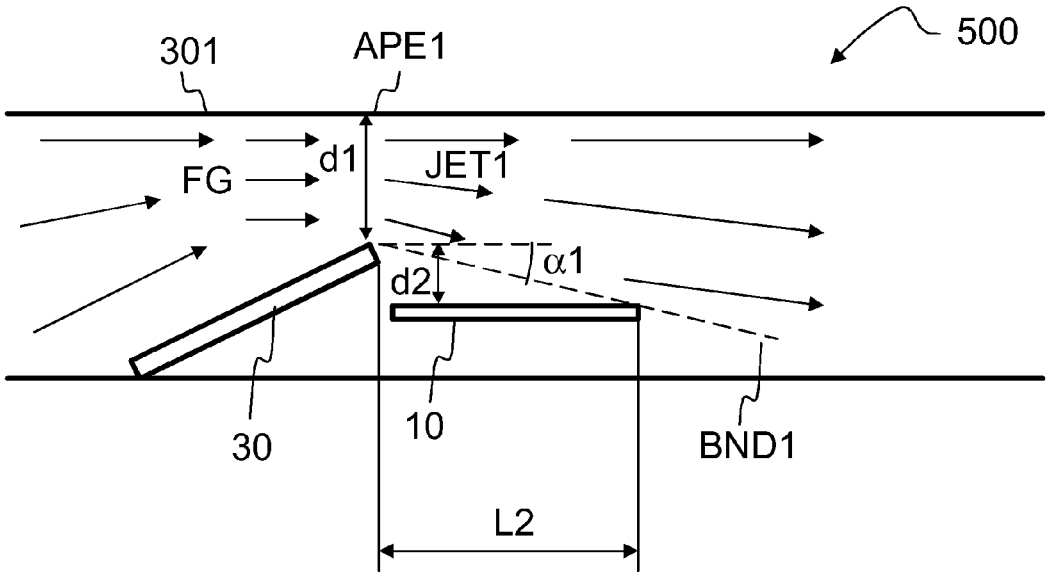
FIG. 5 shows an alternative flow guiding structure.

Referring to FIG. 5, the flow guiding structure 30 may also be a flow guiding plate or vane (i.e. a baffle), which is positioned in a gas flow duct 301 such that said baffle 30 controls the direction of the gas jet JET1 and shields particles deposited on the effective collecting area EFFZ from the gas flow.

The flow guiding structure 30 is preferably at the same potential as the counter-electrode 20 in order to minimize neutralization of charged particles P1 on the flow guiding structure 30. In other words, the flow guiding structure 30 may be electrically insulated from the collecting electrode 10. In other words, the flow guiding structure 30 may be in a different electric potential than the collecting electrode 10.

Figure 6A:
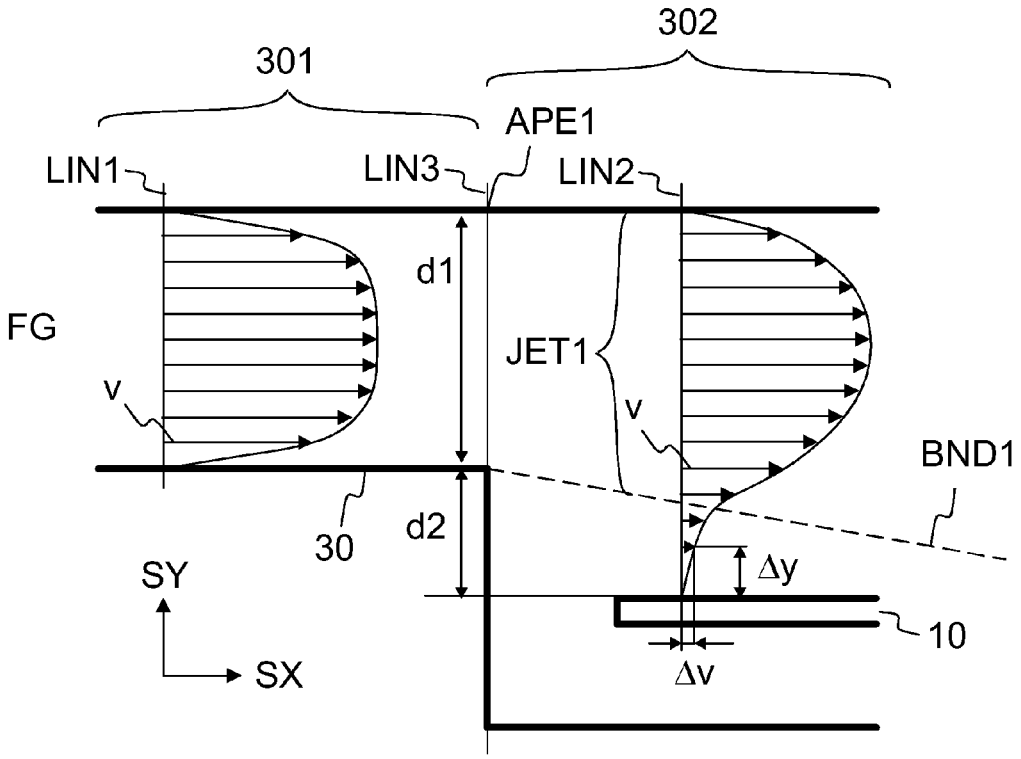
FIG. 6*a* shows, by way of example, gas velocity distributions above the collecting electrode and in the inlet duct of a gas cleaning device.

FIG. 6*a* shows, by way of example gas velocity distributions in the inlet duct 310 and in the electrode chamber 302.

The length of arrows drawn from the vertical line LIN1 indicate horizontal gas velocities at different vertical positions in the inlet duct 301.

The length of arrows drawn from the vertical line LIN2 indicate horizontal gas velocities at different vertical positions in the electrode chamber 302.

LIN3 indicates the position of the end of the flow guiding structure 30, i.e. the position of the aperture APE1.

Figure 6B:
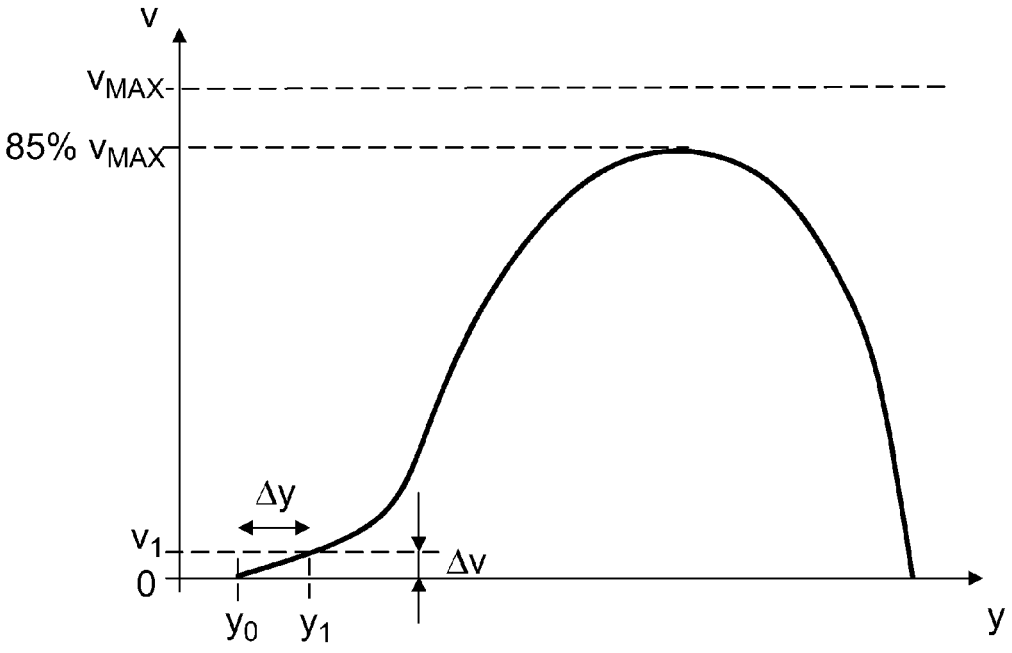
FIG. 6*b* shows, by way of example, a gas velocity distribution above the collecting electrode.

FIG. 6*b* shows a gas velocity distribution along the direction SY. y denotes vertical position coordinate in the direction SY, and v denotes gas velocity.

It is expected that the maximum gas velocity $V_{MAX}$ of the gas jet JET1 is found at the location of the aperture APE1, on the line LIN3. The maximum gas velocity at the line LIN2 above the collecting electrode 10 may be slightly lower. The maximum gas velocity above the collecting electrode 10 may be e.g. 85% of the maximum velocity $V_{MAX}$.

$y_0$ denotes the location of the upper surface of the collecting electrode 10. $y_1$ denotes a location above the upper surface of the collecting electrode 10. $v_1$ denotes gas velocity at the height y1. The position y1 may be e.g. 1 cm above the surface of the collecting electrode.

The effective collecting area EFFZ of the collecting electrode 10 may be positioned such that the absolute value of the velocity gradient $\Delta v/\Delta y$ in the vicinity of the effective collecting area EFFZ is smaller than a predetermined limit, so that deposited particles are not blown away by the gas flow to a significant degree.

The gas velocity gradient $\Delta v/\Delta y$ at each point of the effective collecting area EFFZ may be e.g. smaller than 10% of the maximum gas velocity $V_{MAX}$ in the gas jet JET1 divided by the height dimension d1' of said jet.

The gas velocity gradient $\Delta v/\Delta y$ at each point of the effective collecting area EFFZ may be e.g. smaller than 10% of the maximum gas velocity $V_{MAX}$ in the gas jet JET1 divided by the height dimension d1 of the aperture APE1.

The maximum gas velocity $v_{MAX}$ in the gas jet JET1 may be kept e.g. smaller than or equal to 10 m/s. In order to provide higher particle collection efficiency, the maximum gas velocity $v_{MAX}$ in the gas jet JET1 may be kept smaller than or equal to 1.0 m/s.

The maximum gas velocity $v_{MAX}$ may be e.g. 10 m/s, and the height dimension d1' of the gas jet JET1 may be e.g. 5 cm. In this case the velocity gradient $\Delta v/\Delta y$ may be kept e.g. smaller than or equal to 20 $s^{-1}$ ($=10\% \cdot v_{MAX}/d1'$).

The maximum gas velocity $v_{MAX}$ may be e.g. 10 m/s, and the height dimension d1 of the aperture APE1 may be e.g. 5 cm. In this case the velocity gradient $\Delta v/\Delta y$ may be kept e.g. smaller than or equal to 20 $s^{-1}$ ($=10\% \cdot v_{MAX}/d1$).

The velocity gradient $\Delta v/\Delta y$ may even be e.g. smaller than or equal to 2 $s^{-1}$ in order to provide higher collection efficiency.

Said low velocity gradient condition may be fulfilled at each point of the effective collecting area EFFZ, i.e. over the whole effective collecting area EFFZ.

Instead of using a predetermined velocity gradient as a criterion for "outside the gas jet JET1", it may be defined that the gas velocity at a predetermined height is lower than or equal to a predetermined value. For example, the gas velocity at 1 cm above the effective collecting area EFFZ may be e.g. smaller than or equal to 10% of the maximum velocity $V_{MAX}$ and/or the gas velocity at 1 cm above the effective collecting area EFFZ may be e.g. smaller than or equal to 20 cm/s. In this case, the dimensions d1 and d1' may be e.g. smaller than or equal to 30 cm, and preferably smaller than or equal to 10 cm.

Said low velocity condition may be fulfilled at each point of the effective collecting area EFFZ.

In particular, the gas cleaning device 500 may comprise:

- a charging unit 150 arranged to form charged particles P1 by charging particles P0 of a particle-laden gas FG,
- a flow guiding structure 30 arranged to provide a gas jet JET1 by guiding said particle-laden gas FG, and
- a collecting electrode (10) having an effective collecting area EFFZ arranged to collect particles P1 from said gas jet JET1 by an electric field E1, wherein said effective collecting area EFFZ is positioned such that gas velocity at a distance $\Delta y$ of 1 cm from said effective collecting area EFFZ is smaller than or equal to 10% of the maximum gas velocity $V_{MAX}$ of said gas jet JET1, said distance $\Delta y$ being in the main direction of said electric field E1.

It may be noticed that the terminal settling velocity of a unit density sphere is 25 cm/s, when the particle diameter is 100 μm, when the gas is air, and when the temperature is 20° C. This means that

- when the deposited nanoparticles are falling from the collection electrode 10 as agglomerates,
- when the diameter of the agglomerates is greater than 100 μm, and
- when the detached agglomerates do not rise higher than 1 cm above the surface of the collection electrode 10, then it can be estimated that a gas velocity 20 cm/s at the height of 1 cm above the surface of the collection electrode does not yet significantly capture the agglomerated particles back to the gas jet JET1.

A smaller limit, e.g. 2 cm/s may provide even better collection efficiency. Thus, the gas velocity at 1 cm above the effective collecting area EFFZ may be e.g. smaller than or equal to 2 cm/s, at each point of the effective collecting area EFFZ.

The gas cleaning device 500 may be connected to a flue gas duct of a combustion facility, or to an exhaust gas duct of an industrial facility. The combination of a combustion facility and the gas cleaning device 500 may be arranged such that the gas velocity at 1 cm above the effective collecting area EFFZ is smaller than or equal to smaller than or equal to 20 cm/s, or even smaller than or equal to 2 cm/s.

Figure 6C:
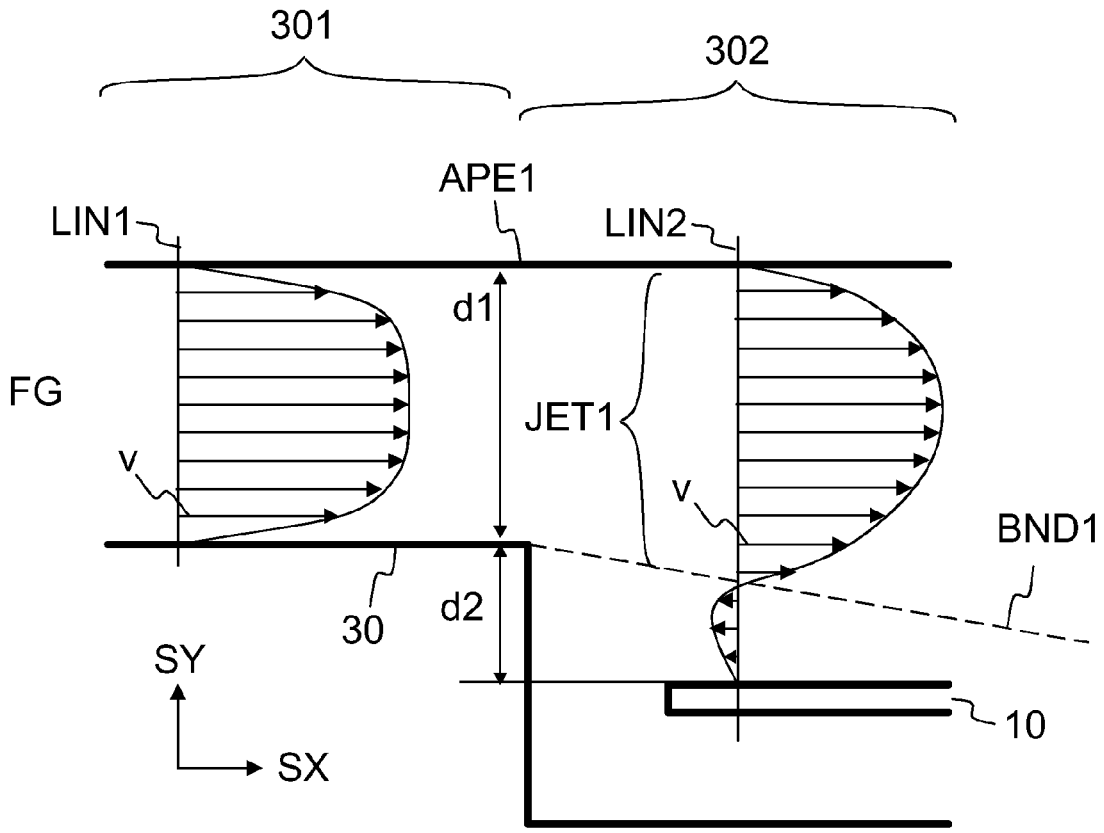
FIG. 6*c* shows, by way of example, gas velocity distribution above the collecting electrode in case of a recirculation vortex.

Referring to FIG. 6*c*, gas velocities in the vicinity of the electrode 10 may also be negative due to a recirculation vortex. Even if the electrode 10 is positioned away from the main gas jet JET1, the recirculation vortex might remove some particles from the electrode 10. The effect of a recirculation vortex may be minimized e.g. by positioning the electrode to a sufficient distance from the gas jet JET1, and/or by selecting the shape of the electrode chamber 302 (See FIGS. 9*a*, 9*b*).

The upper side of the collecting electrode 10 may be substantially parallel to the inlet duct 301, but it does not need to be. The upper side of the collecting electrode 10 may also be e.g. parallel to the boundary BND1 so that a long collecting area EFFZ can be kept below the boundary BND1. Even the whole upper surface of a very long collecting electrode 10 can be kept below the boundary BND1.

Referring to FIG. 7, the collecting electrode 10 may also be positioned to the side of the gas duct 304, i.e. to the side of the gas jet JET1. Also in that case particles released from the electrode 10 may fall to the bottom, instead of being entrained back into the gas jet JET1.

The gas jet JET1 may also be substantially vertical. For example, the gas jet JET1 may be substantially parallel to the direction SY (not shown in the figures).

FIG. 8 shows a comparative example where the electrode 10 is positioned above the gas duct 304. In that case deposited particles falling from the electrode 10 would be introduced back to the gas jet JET1, and the efficiency of the gas cleaning device 500 would be degraded.

Figure 9A:
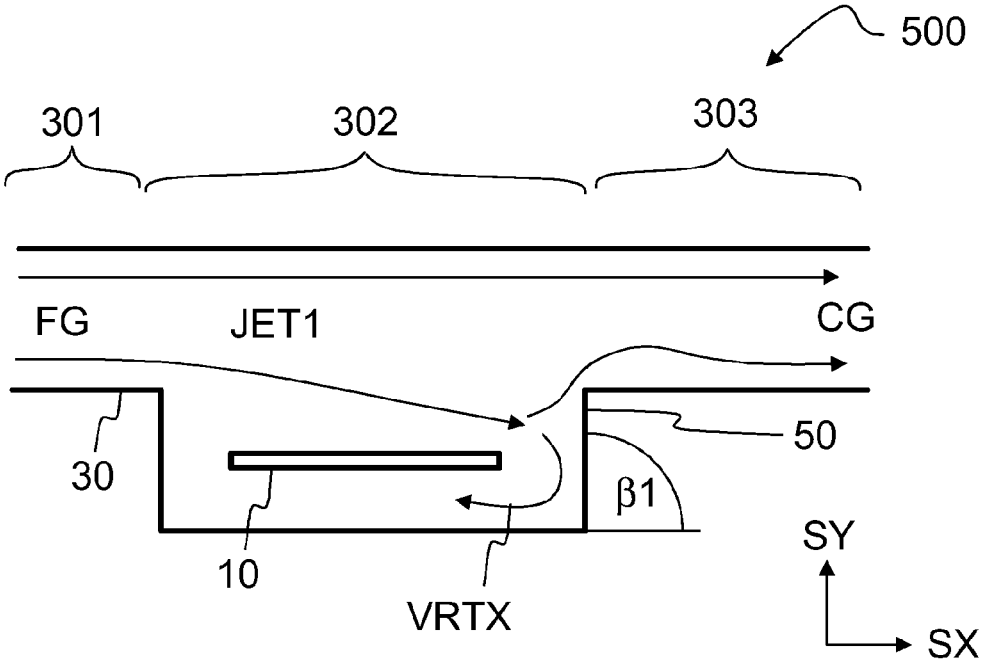
FIG. 9*a* shows a recirculation vortex caused by a gas flow impinging on a substantially vertical surface in the electrode chamber.

FIG. 9*a* shows a recirculation vortex VRTX caused by the gas jet JET1 impinging on a substantially vertical back wall 50 of the electrode chamber 302. β1 denotes an angle between the back wall 50 and the direction SX. The inlet duct 301 may be parallel to the direction SX.

Figure 9B:
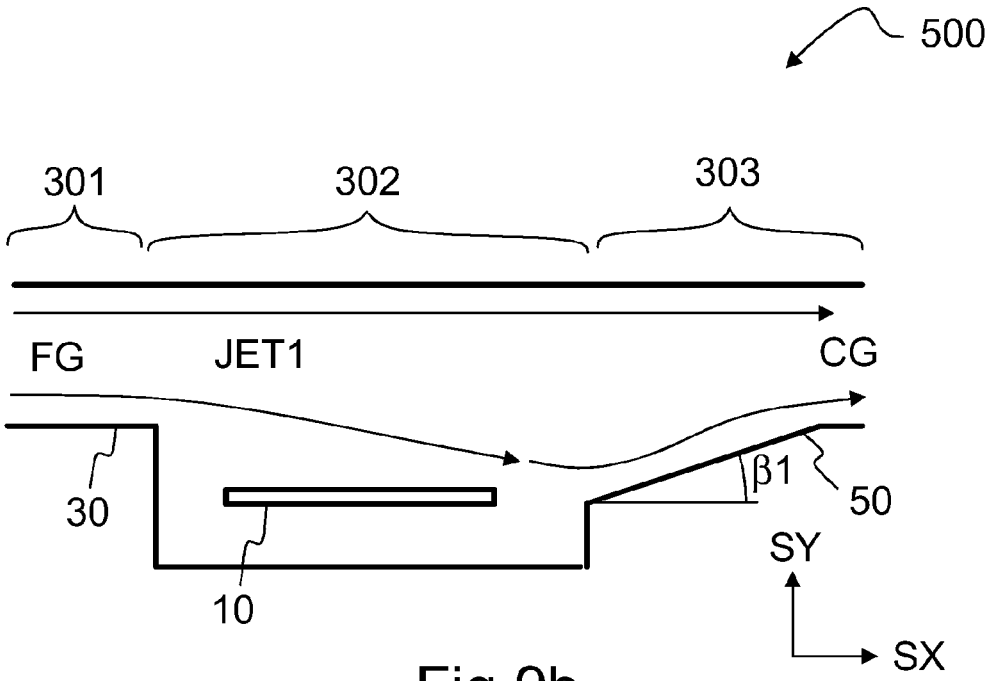
FIG. 9*b* shows an inclined surface arranged to minimize the recirculation vortex.

Referring to FIG. 9*b*, the effect of the recirculation vortex VRTX may be reduced or eliminated e.g. by using an inclined back wall 50 of the electrode chamber for guiding the gas jet JET1 into an outlet duct 303. The angle β1 may be e.g. in the range of 5° to 45°.

Figure 10A:
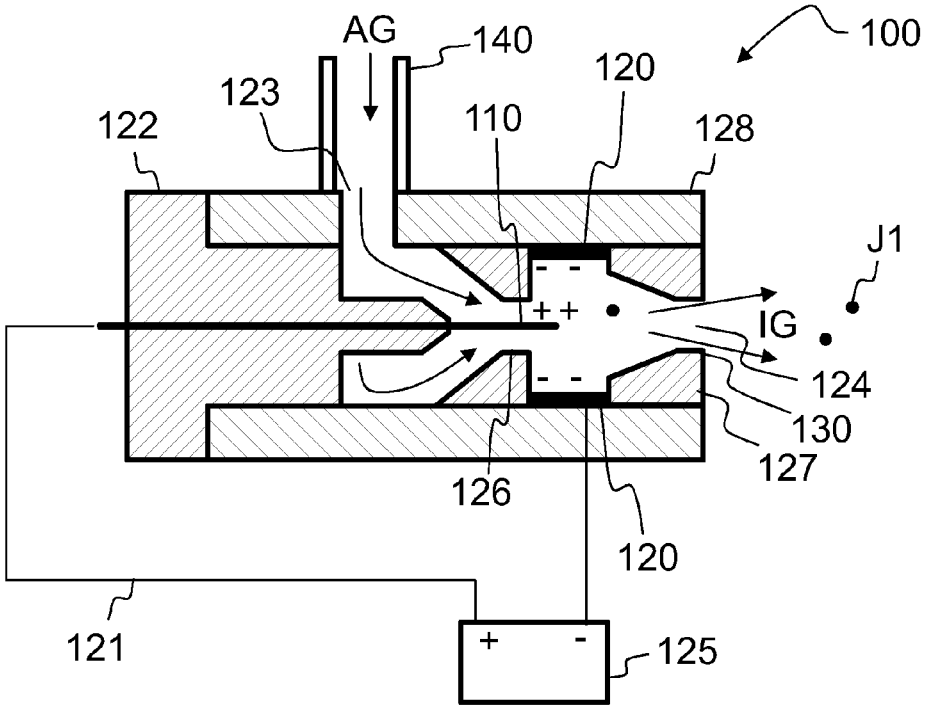
FIG. 10*a* shows an ion source based on corona discharge.

FIG. 10*a* shows an ion source 100. The ion source 100 may comprise a corona electrode 110, a counter-electrode 120, a gas input 123, and a gas output 124.

A voltage may be applied between the coronal electrode 110 and the counter electrode 120 so as to create a corona discharge. The voltage may be provided by a voltage supply 125. The voltage may be e.g. in the range of 0.1 kV to 20 kV. The voltage may be coupled to the corona electrode via a conductor 121. The corona electrode 110 may be rod. The corona electrode may also have a sharp point, i.e. the corona electrode 110 may be a needle. The counter-electrode 120 may be e.g. tubular.

The counter-electrode 120 may be e.g. a portion of a metallic tube, which is supported by a second supporting structure 128. An insulator 122 may support the corona electrode 110 and keep its separate from the counter-electrode. The electrodes 110,120 may be axially symmetric. The electrodes 110, 120 may be arranged substantially co-axially.

Substantially particle-free gas AG may be guided to the input 123 e.g. via a tube 140. At least a portion of the particle-free gas AG may be guided to a discharge region in the vicinity of the corona electrode 110.

The discharge region may be located in the vicinity of the tip of the electrode 110. At least a portion of the molecules (and/or atoms) of the gas are ionized by the corona discharge. Thus, the output 124 of the ion source 100 may provide a stream of ionized gas IG, which comprises ions J1. The polarity of the ions J1 may be selected by selecting the polarity of the corona electrode 110.

The gas AG may be e.g. air, water vapor, carbon dioxide or nitrogen. The gas AG may be substantially particle-free, which means that the particle concentration is so low that deposited particles do not cause significant contamination of the inner parts of the ion source 100. The gas AG may be provided e.g. by a pump (not shown). The flow rate of the gas AG may be regulated by a regulating unit (not shown).

To some extent, ion production rate may be increased by increasing the corona voltage, but this also increases the electric current between the electrodes 110,120. This may significantly increase power consumption of the ion source 100.

It has been noticed that the ion production rate may also be increased by increasing gas velocity in the discharge region. The ion source 100 may comprise a first flow guiding element 126 arranged to increase gas velocity in the vicinity of the corona electrode 110, in order to increase the rate of ion production. In particular, the first flow guiding element 126 may be a constriction.

The ion source 100 may comprise a second flow guiding element 127 arranged to prevent access of external particle-laden gas to the space between the electrodes 110, 120. In other words, the second flow guiding element 127 may be arranged to prevent contamination of the electrodes 110, 120. In particular, the second flow guiding element 127 may be a constriction.

The second flow guiding element 127 may also act as the nozzle 130, i.e. the second flow guiding element 127 may be arranged to inject ionized gas IG to particle-laden gas.

Figure 10B:
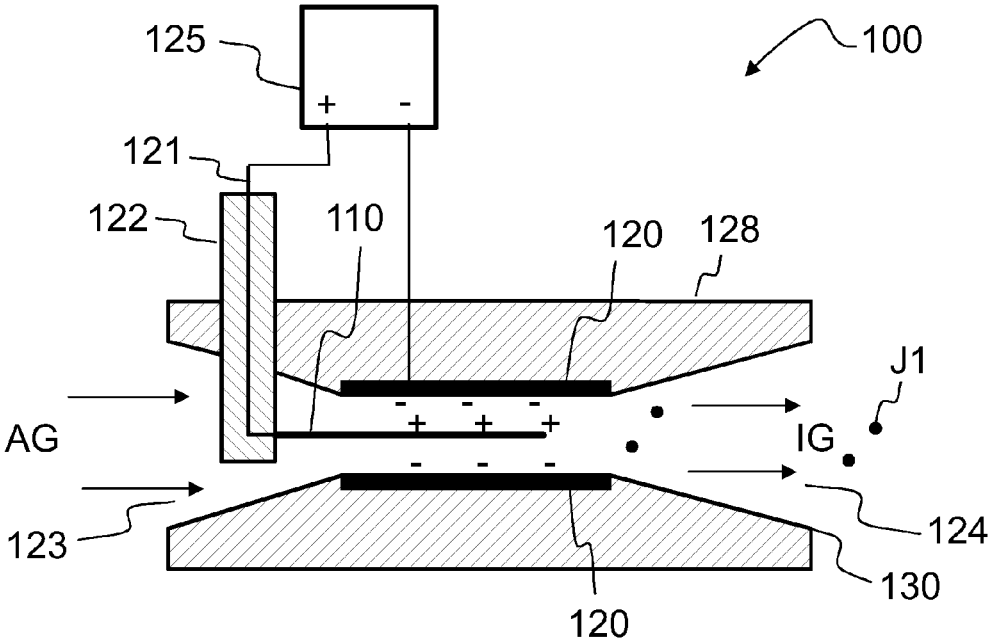
FIG. 10*b* shows an ion source based on corona discharge.

Referring to FIG. 10*b*, the particle-free gas AG may also introduced to the ion source 100 along a substantially linear path. A first support 122 may hold the corona electrode 110. The ion source 100 may further comprise a second support 128 for holding the counter-electrode 120 and the first support 122. At least one of the first support 122 and the second support 128 should be electrically insulating.

A portion of the second support 122 may act as a nozzle 130 for injecting ionized gas IG to particle-laden gas FG. Also in this case, the ion source 100 may comprise a first flow guiding element (not shown) for increasing gas velocity in the vicinity of the corona electrode 110 and/or a second flow guiding element (not shown) arranged to prevent circulation of particle-laden gas to the electrodes 110, 120.

Figure 11:
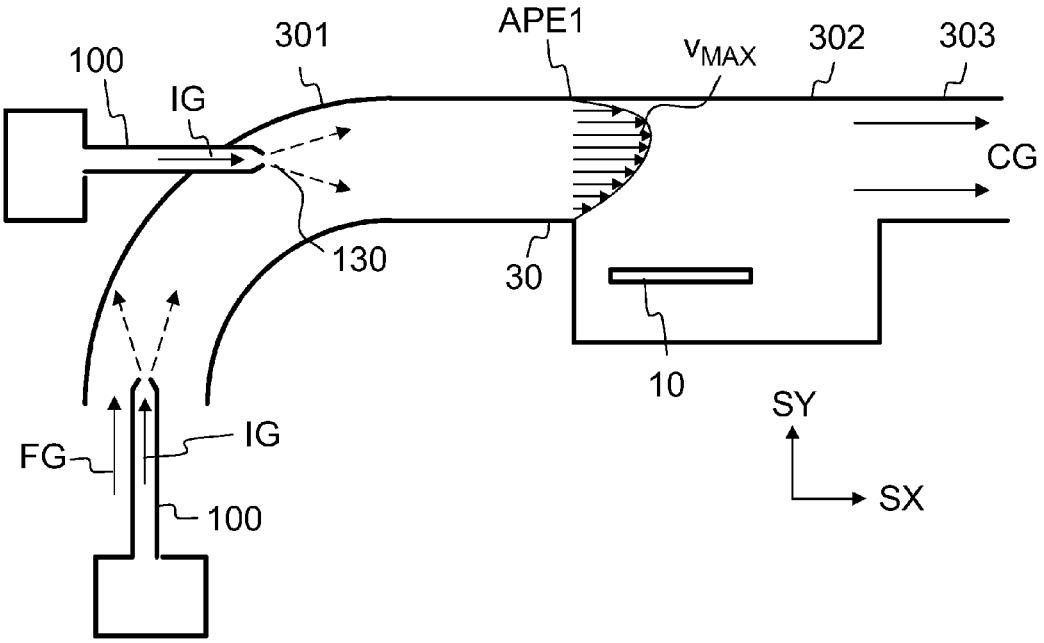
FIG. 11 shows a gas cleaning device comprising a curved inlet duct arranged to modify gas velocity distribution in the gas jet.

Referring to FIG. 11, a curved portion of the inlet duct 301 may be arranged to modify the velocity distribution of the gas jet JET1.

If the inlet duct 301 is bent, the ionized gas IG may also be introduced into the inlet duct 301 along a substantially linear path.

FIG. 11 also shows that ionized gas IG may be mixed with particle-laden flue gas FG at several successive locations in order to increase the residence time of particles in the charging zone CHRZ. The device 500 may comprise two or more ion sources 100. This is expected to further reduce the number of neutral particles P0 carried by the gas, i.e. to further increase the collection efficiency.

Referring to FIG. 12*a*, the inlet duct 301 and the outlet duct 303 may be connected to a gas duct 304, which has an opening 306. In particular the parts 301, 303, and 304 may be portions of the same tube. The inlet duct 301 may act as the flow guiding structure 30, which forms the gas jet JET1.

In this case, only the lower part of the gas jet JET1 is substantially free. The upper part of the jet JET1 is confined to the duct 304.

Referring to FIG. 12*b*, the inlet duct 301 may have a substantially rectangular cross section. d1 denotes the height dimension of the flow-defining aperture APE1 in the direction SY. w1 denotes the width of the flow-defining aperture APE1 in the direction SZ. The gas cleaning device 500 may further comprise an inclined surface 50 to guide gas into the outlet duct 303 (See also FIG. 9*b*).

The operating parameters and the dimensions of the gas cleaning device 500 may be selected such that the efficiency for separating e.g. 100 nm particles is maximized. In this context, separation efficiency means the number of separated particles of a predetermined size to the total number of particles of said predetermined size.

The gas cleaning device 500 may be arranged to separate e.g. 40-90% of nanoparticles from the gas FG. Thus, the concentration of nanoparticles in the cleaned gas CG may be e.g. 10%-60% of the concentration of nanoparticles in the particle-laden gas FG, respectively. Thus, emission of harmful particles to the atmosphere may be significantly reduced.

The gas cleaning device 500 may be arranged to remove particles from a flue gas originating e.g. from a combustion process, a combustion engine, a chemical process, a welding process, a glass heating process, or a galvanizing process.

The particles may have been formed e.g. via condensation from the gas phase.

The particle-laden FG gas and the ionized gas IG may be mixed e.g. by turbulence caused by a stream of ionized gas IG flowing through the nozzle 130. In other words, the nozzle 130 may be arranged to enhance mixing by turbulence. When velocity of the ionized gas IG ejected from the ion source 100 is high when compared to the velocity of the particle-laden gas FG, this may naturally create turbulence.

However, turbulence is typically not necessary for charging the particles. A space charge of ions J1 ejected from the ion source (100) may effectively distribute the ions J1 within the particle-laden gas FG. The space charge may distribute the ions J1 substantially over the entire cross-sectional area of the inlet duct 301. In that case, the flow in the inlet duct 301 may be substantially laminar even after the nozzle 130 of the ion source 100. The dimensions of the gas cleaning device 500, the velocity of the ionized gas ejected from the ion source 100, and the velocity of the particle-laden gas FG may be selected such that gas jet JET1 may be substantially laminar. The substantially laminar gas jet JET1 may facilitate providing a high degree of particle separation. In that case, deflected particles are not re-entrained back into the flow due to turbulence.

For the person skilled in the art, it will be clear that modifications and variations of the devices according to the present invention are perceivable. The figures are schematic. The particular embodiments described above with reference to the accompanying drawings are illustrative only and not meant to limit the scope of the invention, which is defined by the appended claims.

The invention claimed is:

1. A gas cleaning device, comprising:

a charging unit configured to form charged particles by charging particles of a particle-laden gas;

a flow guiding structure configured to provide a gas jet by guiding said particle-laden gas; and a collecting electrode having an effective collecting area configured to collect particles from said gas jet by an electric field, wherein said effective collecting area is positioned such that gas velocity gradient at each point of said effective collecting area is smaller than or equal to 10% of a maximum gas velocity of said gas jet divided by a height dimension of said jet, said height dimension being determined at a location of said flow guiding structure.

2. The device according to claim 1, wherein said charging unit comprises an ion source arranged to provide ionized gas by ionizing substantially particle-free gas.

3. The device according to claim 2, wherein said ion source is arranged to generate ions by a corona discharge.

4. The device according to claim 3, wherein said ion source comprises a corona electrode and a counter electrode, and wherein access of said particle-laden gas to a space between the corona electrode and the counter electrode is substantially prevented.

5. The device according to claim 2, wherein said charging unit is arranged to mix ionized gas with said particle-laden gas in an inlet duct.

6. The device according to claim 5, wherein said ionized gas is introduced to the inlet duct via a nozzle, and wherein a distance between said nozzle and said collecting electrode is greater than or equal to 50 cm.

7. The device according to claim 1, wherein a length of said effective collecting area is greater than or equal to three times the height dimension of said jet.

8. The device according to claim 1, wherein said flow guiding structure is arranged to be in a different electric potential than said collecting electrode.

9. A method for separating particles from particle-laden gas, said method comprising:

forming charged particles by charging particles of a particle-laden gas;

providing a gas jet by guiding said particle-laden gas by a flow guiding structure; and collecting particles from said gas jet to an effective collecting area of a collecting electrode by an electric field, wherein said effective collecting area is positioned such that a gas velocity gradient at each point of said effective collecting area is smaller than or equal to 10% of a maximum gas velocity in said gas jet divided by a height dimension of said jet, said height dimension being determined at a location of said flow guide.

10. The method according to claim 9, wherein a furthermost point of said effective collecting area is positioned such that a charged particle traveling at a center of said gas jet impinges on said effective collecting area, when a diameter of said charged particle is 100 nm.

11. The method according to claim 9, wherein the electric field, a gas velocity and a transverse distance from a center of the jet to the collecting electrode have been selected such that a traveling time of a 100 nm particle from the center of the gas jet to the collecting electrode is in the range of 0.5 to 2 s.

12. The method according to claim 9, wherein a flow rate of said particle-laden gas is kept below a predetermined limit such that a charged particle traveling at a center of said gas jet impinges on said effective collecting area, when a diameter of said charged particle is 100 nm.

13. The method according to claim 9, wherein said forming charged particles comprises mixing said particle-laden gas with ionized gas generated by ionizing substantially particle-free gas.

14. The method according to claim 13, further comprising:

generating ions by a corona discharge.

15. The device according to claim 14, wherein said ions are generated by an ion source comprising a corona electrode and a counter electrode, and wherein access of said particle-laden gas to a space between the corona electrode and the counter electrode is substantially prevented.

16. The method according to claim 13, further comprising:

mixing ionized gas with said particle-laden gas in an inlet duct.

17. The method according to claim 13, further comprising:

introducing said ionized gas to an inlet duct via a nozzle such that a distance between said nozzle and said collecting electrode is greater than or equal to 50 cm.

18. The method according to claim 9, wherein the gas velocity 1 cm above each point of said effective collecting area is smaller than or equal to 20 cm/s.

19. The method according to claim 9, wherein the velocity gradient at each point of said effective collecting area is smaller than or equal to 20 $s^{-1}$.

20. The method according to claim 9, wherein a length of said effective collecting area is greater than or equal to three times the height dimension of said jet.

21. The method according to claim 9, wherein said flow guiding structure is in a different electric potential than said collecting electrode.

* * * * *